United States Patent [19]

Kovach

[11] Patent Number: 4,478,391

[45] Date of Patent: Oct. 23, 1984

[54] FENCE PROTECTOR

[76] Inventor: Nickolas C. Kovach, 708 NW. 40th Ter., Kansas City, Mo. 64116

[21] Appl. No.: 526,484

[22] Filed: Aug. 25, 1983

[51] Int. Cl.³ ..... E04H 17/06

[52] U.S. Cl. ..... 256/1; 256/32

[58] Field of Search ..... 256/32, 1; 272/56, 555; 47/33, 32, 25

[56] References Cited

U.S. PATENT DOCUMENTS

| | | | |
|---|---|---|---|
| 3,384,351 | 5/1968 | Turner, Jr. | 256/32 |
| 3,545,127 | 12/1970 | Jensen | 47/33 |
| 3,704,004 | 11/1972 | Carter, Jr. | 47/32 X |
| 3,713,624 | 1/1973 | Niemann | 256/32 |
| 3,768,780 | 10/1973 | Cowles | 256/1 |
| 3,806,096 | 4/1974 | Ecclestoy | 256/32 |
| 4,349,989 | 9/1982 | Snider, Jr. | 256/32 X |

*Primary Examiner*—Andrew V. Kundrat

*Attorney, Agent, or Firm*—Kokjer, Kircher, Bradley, Wharton, Bowman & Johnson

[57] ABSTRACT

This invention relates to a vegetation guard to be placed beneath a fence. The device includes a plurality of polygonal sections adapted to be disposed in end to end relationship. Each of the sections presents first and second inclined surfaces disposed in intersecting planes on opposite sides of a generally U-shaped trough portion which extends the length of the section. The trough portion is provided with a plurality of openings along its bottom wall to permit water to drain from the trough and herbicide to be applied through the openings. One end of each of the sections is provided with a tongue portion which is adapted to be placed beneath the opposite end of an adjacent section. A fastener passes through openings in the two overlapping sections which are configured so as to accomodate a limited amount of longitudinal movement between the two sections for thermal expansion and contraction.

3 Claims, 3 Drawing Figures

FENCE PROTECTOR

BACKGROUND OF THE INVENTION

This invention relates generally to fencing borders and, more particularly, to an edging to be placed beneath a fence to prevent vegetation from growing in and around the fencing.

It has long been known that keeping vegetation away from fences is a particular problem. The problem is especially noticeable in residential areas where asthetic considerations are of primary importance. Many types of edging devices have been proposed for use in conjunction with fences to reduce the vegetation growing in and around the fence.

For example, a fence guard is disclosed in U.S. Pat. No. 3,713,624. The device disclosed in this patent is intended to be placed along side and beneath a chain link fence.

Another type of vegetation barrier is disclosed in U.S. Pat. No. 3,806,096.

A grass guard in roll form is disclosed in U.S. Pat. No. 3,384,351.

A ground collar or skirt for fence posts is disclosed in U.S. Pat. No. 3,704,004.

U.S. Pat. No. 3,768,780 discloses a fence border designed to be placed beneath a fence member.

The foregoing devices, while addressing the problem of vegetation growing in and around fences, fail to provide a practical, economical solution. The devices of the prior art have completely failed to take into account the problem of thermal expansion and contraction which is inherent in any structure located in the outdoors. The constructions of the prior art also fail to provide appropriate interlocking members so as to assure that the device will remain in place. Another deficiency of the prior art constructions has been that they tend to simply sit on the surface in such a manner that it is easy to displace the structure whenever a lawn mower or other object strikes against it.

OBJECTS OF THE INVENTION

It is therefore a primary object of the present invention to provide a vegetation barrier for fences which presents a smooth continuous uninterrupted surface beneath a fence.

Another very important object of this invention is to provide a vegetation barrier for fences which includes means for distributing herbicide beneath the vegetation barrier.

As a corrolary to the foregoing object, an important aim of the invention is to provide a vegetation barrier for fences which is designed to be placed beneath the fence and which includes means for draining water from the barrier so that when used in conjunction with a wooden fence accumulated moisture will not shorten fence life.

Another very important object of the invention is to provide a vegetation barrier for fences comprised of a plurality of sections which interlock so as to preclude displacement.

As a corollary to the foregoing object, an important one of the aims of my invention is to provide a vegetation barrier comprised of interlocking sections wherein allowance for thermal expansion and contraction is provided.

Still another one of the objectives of the invention is to provide a vegetation barrier for fences designed to be placed beneath the fence and wherein the construction of the barrier is such as to actually rip the turf and be held against lateral movement by the turf itself as the latter grows around the barrier.

Other objects of the invention will be made clear or become apparent from the following description and claims when read in light of the accompanying drawing.

Figure 1:
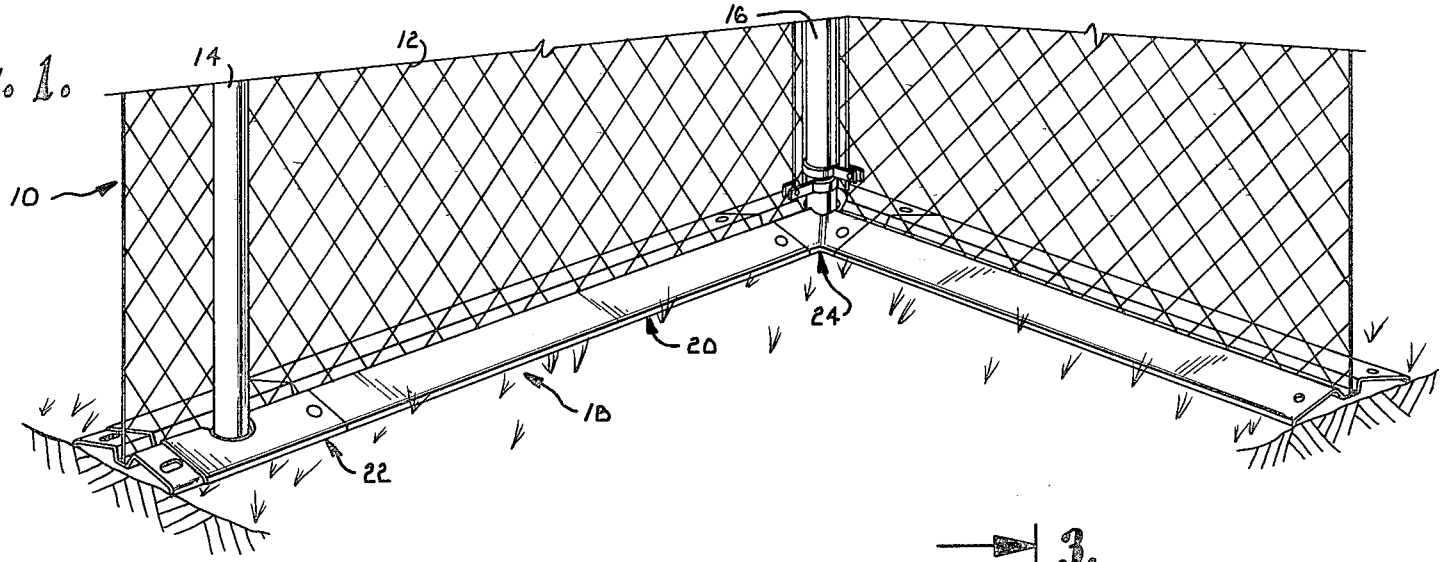
FIG. 1 is a perspective view showing the fence protector according to the present invention in assembled relationship in place beneath a fence.

Referring initially to FIG. 1, a chain link fence is designated generally by the numeral 10 and includes a wire mesh 12, line posts 14 and one or more corner posts 16.

The fence protector of the present invention is designated generally by the numeral 18 and includes a plurality of polygonal sections 20, 22 and 24 disposed in interlocking relationship.

Figure 2:
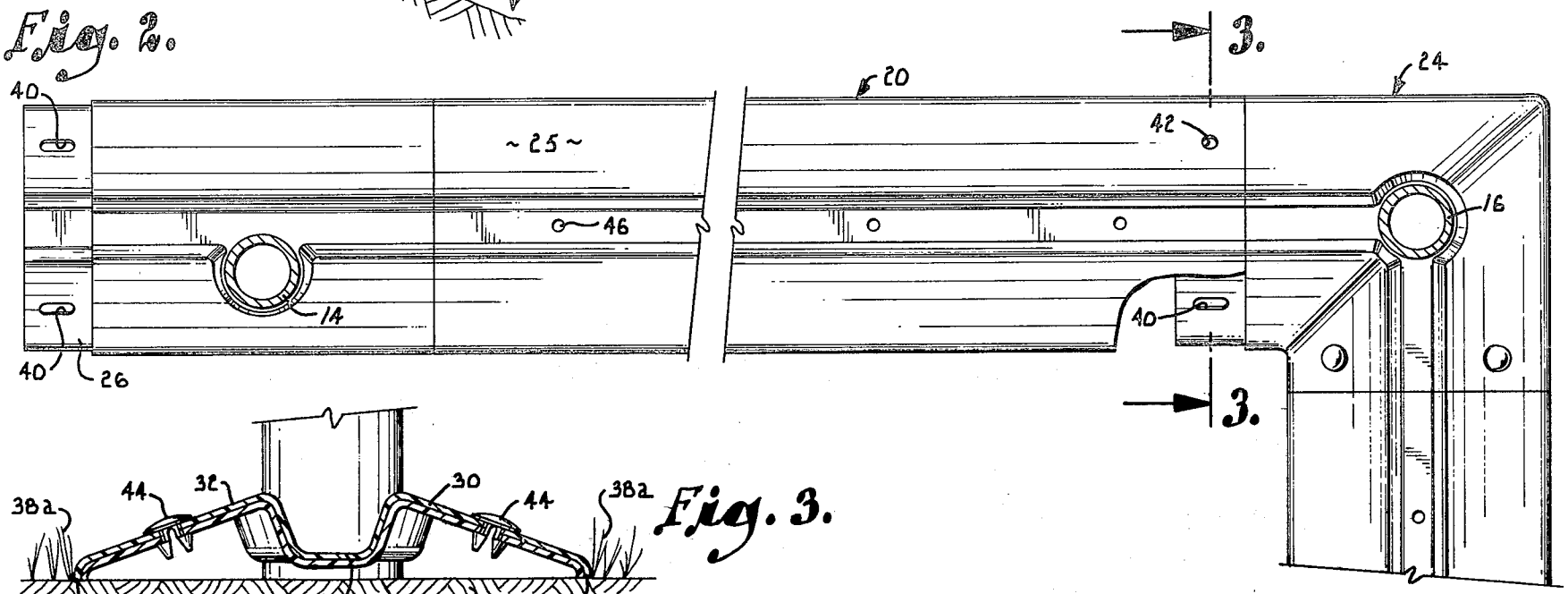
FIG. 2 is an enlarged top plan view of the fence protector, the fence having been removed for purposes of illustration.
Figure 3:
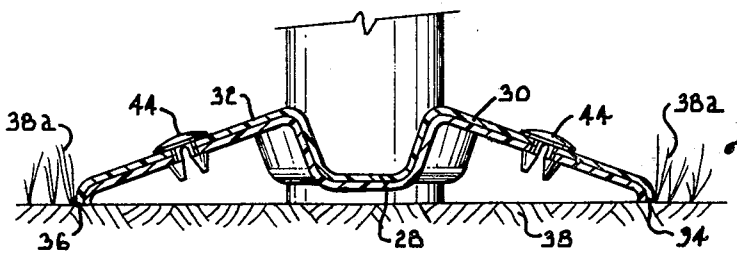
FIG. 3 is a horizontal cross-sectional view taken along line 3—3 of FIG. 2.

Referring additionally to FIGS. 2 and 3, polygonal section 20 is shown in greater detail. Section 20 is of generally rectangular elongated configuration having main body portion 25 and tongue portion 26 at one end. The cross-sectional configuration of section 20 includes a generally U-shaped central trough portion 28 which merges into and is integral with first and second inclined surfaces 30 and 32. Surfaces 30 and 32 are disposed in intersecting planes and are separated by trough 28. Each of the surfaces 30 and 32 merges into a generally vertical foot portion 34 and 36 respectively. Foot portions 34 and 36 are disposed generally perpendicular to the supporting turf 38. It is to be noted that the cross-sectional configuration of tongue portion 26 is identical to the cross-sectional configuration of the main body portion 25 but the tongue portion is closer to turf 38 by a distance equal to the thickness of the main body portion of the section.

An important aspect of the invention is that tongue portion 26 includes slots 40 and at the opposite end of the main body portion apertures 42 are disposed for alignment with the slots 40 of an adjoining section. When the slots and apertures are in alignment keepers 44 are pushed through the aligned openings so as to lock the sections together. Keepers 44 are preferably of the rivet type with an enlarged head and feet which can be pressed together to pass through the openings but with sufficient memory to spread apart once they are in place.

Each of sections 20, 22 and 24 is identical in cross-sectional configuration and each has a main body portion and a tongue portion. The only difference in the three sections is their general polygonal configuration. Sections 20 are generally rectangular as previously described, sections 22 are shorter with provision for an opening to accomodate post 40, and section 24 presents a right angle L with an opening for corner post 16. When the sections are interlocked together by keepers 44 it is still possible for limited rectilinear movement between the sections to take place as a result of the elongated slots 40. A plurality of openings 46 along the bottom wall of the trough section 28 serves two purposes. Herbicide may be placed in the trough and will drain through openings 46 to the turf beneath to eliminate vegetation growing beneath the fence protector. Also, when the fence protector is utilized in conjunction with a wooden fence, since the fence sits in the trough portion, openings 46 will allow water to drain from the trough so there will be no accumulation which would shorten the life of such a fence. In this regard, while the invention has been shown herein with particular reference to a chain link fence it is to be understood that it can be utilized with any type of single row fencing.

The inclined surfaces 30 and 32 will accomodate a lawn mower traveling along the edge thereof so that grass 38*a* (FIG. 3) forming part of the turf 38 can be trimmed next to the fence protector. In this regard, an important aspect of the present invention is the provision of vertically extending foot portions 34 and 36 at the terminal end portions of the inclined surfaces 30 and 32. By virtue of the fact that these portions extend vertically substantially perpendicular to the underlying turf, grass 38*a* will grow up next to these portions and substantially "lock" the fence protector 18 against lateral displacement. The fact that the foot portions 34 form an angle of approximately 110 to 120 with the inclined surfaces also serves to add strength to the overall section. This is also true of the configuration of the U-shaped trough portion which, like foot portions 34 and 36 is integral with and merges into surfaces 30 and 32 thus further enhancing the strength and rigidity of the overall construction.

The invention can be utilized in the manner illustrated in the drawing in conjunction with erection of a new fence. When the invention is installed beneath an existing fence, it is to be understood that it will be necessary to cut sections 22 and 24 at their corresponding posts so as to allow the sections to fit around the post. In some instances, premanufactured interlocking sections will be provided for fitting around an existing post. If necessary, wire mesh 12 can also be loosened and lifted in order to slip the sections beneath the fence.

I claim:

1. A device for use in conjunction with a fence, said fence being of the type that extends substantially to the ground, said device comprising:

a plurality of polygonal sections adapted to be disposed in end to end relationship, each of said sections presenting first and second inclined surfaces disposed in opposed intersecting planes, said surfaces being separated by a trough portion extending the length of said section, said trough portion being of generally u-shaped configuration and adapted to be placed between said fence and the ground, there being a plurality of holes along the bottom of the u, one end of each of said sections presenting a tongue portion adapted to be placed beneath the opposite end of an adjacent section; and means for holding said sections together while accomodating limited movement of the sections for thermal expansion and contraction.

2. A device for use in conjuction with a fence, said fence being of the type that extends substantially to the ground, said device comprising:

a plurality of polygonal sections adapted to be disposed in end to end relationship, each of said sections presenting first and second inclined surfaces disposed in opposed intersecting planes, said surfaces being separated by a trough portion extending the length of said section, said trough portion being adapted to be placed between said fence and the ground, one end of each of said sections presenting a tongue portion adapted to be placed beneath the opposite end of an ajacent section; and a rivet type fastener for holding said sections together, there being an opening to receive said fastener at one end of each of said sections and a slot at the opposite end of each of said sections, whereby when a slot on one section is aligned with an opening an another of said sections, said rivet fastener may be inserted in said slot and said opening for holding said sections together while accommodating limited rectilinear movement between said sections.

3. A device for use in conjunction with a fence, said fence being of the type that extends substantially to the ground, said device comprising:

a plurality of polygonal sections adapted to be disposed in end to end relationship, each of said sections presenting first and second inclined surfaces disposed in opposed intersecting planes, said surfaces being separated by a trough portion extending the length of said section, said trough portion being adapted to be placed between said fence and the ground, each of said inclined surfaces terminating in a vertically extending foot portion adapted to be positioned substantially perpendicular to the plane of the underlying turf whereby grass growing next to said foot portions locks said section against lateral displacement, one end of each of said sections presenting a tongue portion adapted to be placed beneath the opposite end of an adjacent section; and means for holding said sections together while accomodating limited movement of the sections for thermal expansion and contraction.

* * * * *